United States Patent [19]

Huber et al.

[11] 4,054,811

[45] Oct. 18, 1977

[54] ELECTRON BEAM COLLECTOR

[75] Inventors: Güenther Huber, Munich; Wolf Wiehler, Neubiberg, both of Germany

[73] Assignee: Siemens Aktiengesellschaft, Berlin & Munich, Germany

[21] Appl. No.: 673,973

[22] Filed: Apr. 5, 1976

[30] Foreign Application Priority Data

Apr. 9, 1975 Germany ..... 2515356

[51] Int. Cl.[2] ..... H01J 23/02; H01J 9/00

[52] U.S. Cl. ..... 313/30; 29/25.14; 228/183; 228/243; 313/39; 313/40; 313/46; 315/5.38

[58] Field of Search ..... 313/30, 39, 40, 46; 315/5.38; 29/25.13, 25.14, 25.15; 228/183, 243

[56] References Cited

U.S. PATENT DOCUMENTS 3,666,980 5/1972 Jackson ..... 313/39

*Primary Examiner*—Rudolph V. Rolinec
*Assistant Examiner*—Darwin R. Hostetter
*Attorney, Agent, or Firm*—Hill, Gross, Simpson, Van Santen, Steadman, Chiara & Simpson

[57] ABSTRACT

An electron beam collector for a high power electron beam tube has a metallic hollow body for receiving the electron beam, a metallic outer body, and an insulating casing interposed between the inner and outer bodies. A plurality of thin sheet metal fins extend radially outwardly from the outer surface of the hollow body to the inner surface of said insulating casing. The fins are each soldered at their inner ends to the hollow body and at their outer ends to the insulating casing.

15 Claims, 3 Drawing Figures

ELECTRON BEAM COLLECTOR

BACKGROUND

1. Field of the Invention

The present invention relates to an electron beam collector for a high power electron beam tube, and particularly to a collector having a metallic hollow body for receiving the electron beam, a metallic outer body, and a casing of electrically insulating material interposed between the two metallic bodies.

2. The Prior Art

U.S. Pat. No. 3,666,980 illustrates an electron beam collector in which the hollow body consists of a relatively massive inner part comprising a hollow body, with an array of yieldable fins, connected to the insulating casing. The longitudinal fins are supported by oblique grooves in the hollow body. This arrangement has the advantage that a favorable thermal transfer is maintained between the hollow body and the insulating casing, and stresses due to differences in the expansion of the bodies are absorbed by the fins and cannot result in excessive pressure on the insulating casing. However, the solder connections between the individual ribs and the insulating casing are relatively large in area, resulting in a probability of local separations, which interrupt the heat transmission. It is not effective to change the construction of the aforesaid patent by making the ribs narrower, since this not only increases the manufacturing expense, but also narrows the heat conduction paths at the roots of the individual longitudinal ribs, as the inner ends of the grooves approach each other.

The German Auslegeschrift No. 1,614,681 describes an arrangement for soldering fins to an insulating ceramic plate. However, since the construction described there does not comprise an assembly in which the insulating casing surrounds the fins, there is no contemplation of problems which arise due to different rates of thermal expansion in a radial direction.

It is desirable to provide an arrangement in which maximum heat conduction is possible, with reduced probability of breaks in the heat transmission elements.

SUMMARY OF THE PRESENT INVENTION

It is a principal object of the present invention to provide a superior construction for an electron beam collector, in which superior heat transmission characteristics are achieved and maintained.

It is another object of the present invention to provide such an arrangement which does not lose its superior heat transmission characteristics at elevated temperatures approaching 1,000°C.

A further object of the present invention is to provide a heat conducting arrangement which has a high degree of elasticity, but in which the solder connections between individual ribs and the insulating casing are formed without breaks or fractures. These and other objects and advantages of the present invention will become manifest by an inspection of the following description and the accompanying drawings.

In one embodiment of the present invention there is provided an electron beam collector having a metallic hollow body for receiving the beam, a metallic outer body, and a casing of electrically insulating material arranged between the two metallic bodies, said hollow body comprising a hollow body core and a plurality of longitudianl fins, said insulating casing being firmly connected to said fins, each of said ribs being less than 0.5 mm. in thickness and formed of strips of sheet metal which are firmly soldered connected at one edge with the hollow body, and at the opposite edge to the insulating casing.

BRIEF DESCRIPTION OF THE DRAWINGS

Reference will now be made to the accompanying drawings in which.

DESCRIPTION OF THE PREFERRED EMBODIMENT

Figure 1:
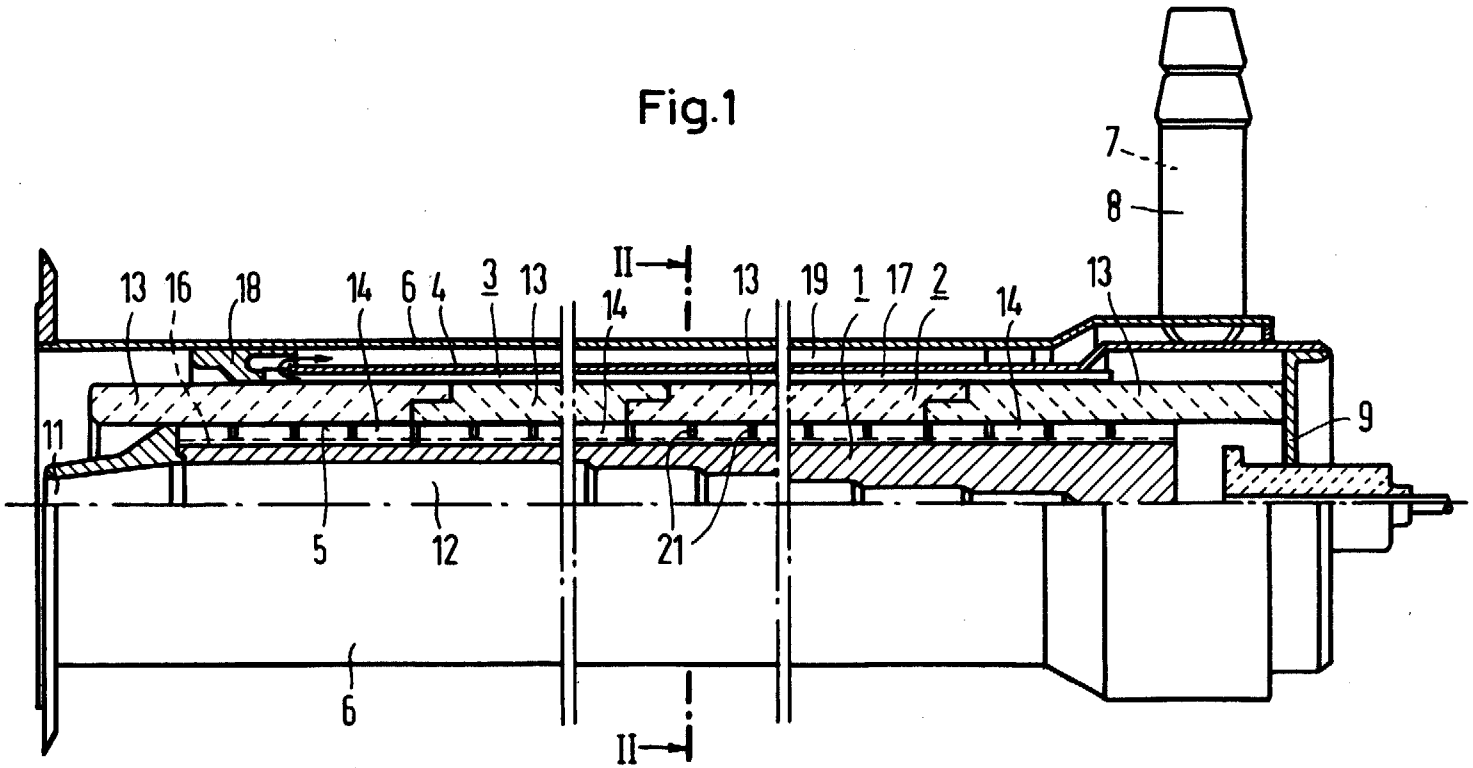
FIG. 1 illustrates a longitudinal cross-section of an illustrative embodiment of the present invention.

The apparatus illustrated in the drawings is a collector for a high power traveling wave tube. The collector consists of a hollow metallic body 1 for receiving the electron beam, an electrically insulting casing 2, and an outer metallic body 3. The outer body 3 serves as the outside pressure wall for the collector, to supoort a vacuum therein, and also supplies cooling. The cooling system is defined by an inner partition 4, an outer partition 6, a coolant inlet connection 7 and a coolant outlet connection 8. A collector end pieces 9 completes the end of the outer body 3.

The hollow body 1 consists of a cylindrical hollow copper block having an electron beam inlet opening 11, and a hollow space 12 which narrows in its diameter in stepwise fashion toward the end of the collector. The insulating casing 2 is formed of beryllium oxide, and preferably takes the form of four partial casings 13 which are axially aligned. Each of the partial casings 13 is provided with an end boss which fits into a recess in its adjacent casing, when assembled as shown in FIGS. 1.

Figure 2:
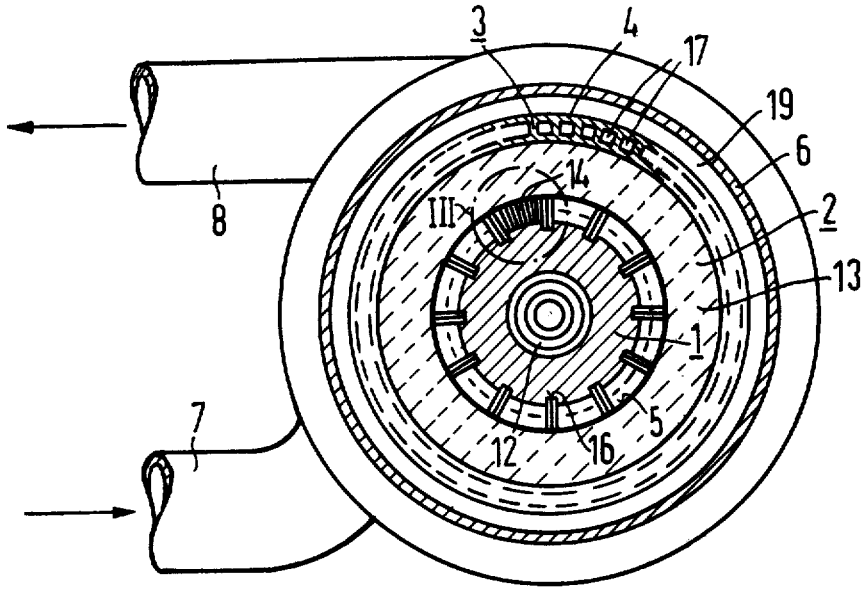
FIG. 2 is a transverse cross-sectional view of the apparatus illustrated in FIG. 1 taken in a plane II—II.
Figure 3:
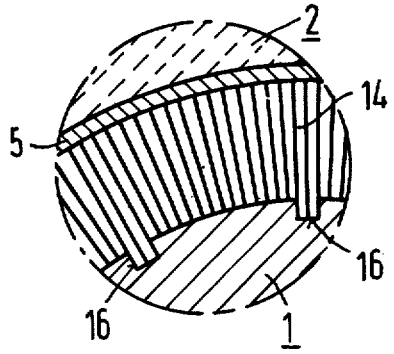
FIG. 3 is an enlarged portion of the apparatus illustrated in FIG. 2.

As illustrated in FIGS. 2 and 3, a plurality of sheet metal fins 14 are situated between the hollow body 1 and the insulating casing 2. The fins are grouped around the body 1 in ray-shaped fashion, and are packed together as densely as possible. They are soldered not only to the insulating casing but also to the hollow body 1. Some of the fins engage longitudinal notches 16 provided in the outer surface of the hollow body 1. In the preferred embodiment, each of the notches has a width sufficient to receive two fins, and the two fins engaged in the notches are slightly larger in a radial direction than the other fins, so that the outer ends of all of the fins define a circular cylindrical surface. Since the fins are preferably very thin, on the order or 0.2 mm., creation of the notches 16 is easier if they are wide enough for two fins rather than one. The fins are preferably formed of chromed copper sheet material.

The insulating casing 2 preferably consists of BeO and is initially metalized, on its outer and inner surfaces, by any known metalizing process. For example the MoMn process may be used. After being metalized, a thin copper layer is applied to both the inner and outer surfaces. The inner copper layer is identified in the figures with the reference numeral 5. The thickness of the copper layer is preferably 1 mm. on the inside surface, and 2 mm. on the outside surface. This arrangement permits the use, for the insulating casing, of a relatively cheap ceramic tube with relatively great tolerances. After the casing is metalized and copper coated, the inner copper layer can be milled to precise dimensions. After milling, the inner copper layer 5 is superimposed with solder, applied preferably by galvanic silver plating.

As shown in FIG. 2, a plurality of individual cooling channels 17 are provided in the outer body 3, and one end 18 of the outer body is provided with an arrangement which allows coolant to flow from the channels 17 into a return channel 19. The channels 17 and 19 are connected with the inlet and outlet connections 7 and 8, and coolant is circulated through the channels during operation.

The collector illustrated in the drawings is preferably assembled by applying, to the outer surface of the hollow body 1, a silver layer which is galvanically applied as solder. Then a plurality of sheet metal strips which form the fins 14 are initially inserted into the longitudinal notches 16, and then the remaining fins are packed as tightly as possible into the resulting intermediate spaces. Then this assembly is inserted into a hollow tube formed of metal or graphite having less heat expansion than copper, and the fins are then soldered to the body 1 at about 800° C., in a soldering furnace having a protective gas atmosphere. The metal or graphite tube into which the body 1 and the fins 14 are placed is relatively constant in size during the heating-soldering process, and accordingly presses the fins against the outside surface of the body 1 during soldering, so that a gap-free soldering takes place. The soldered assembly is then removed from the tube, and the outer ends of the fins 14 are machined so that they define a circular cylindrical surface, fitting exactly with the insulating casing 2. The machined assembly is then connected to the inner surface of the insulating casing, which has been prepared with a copper layer and a superimposed solder surface, in a second soldering operation.

By means of the present invention the fit between the circular cylindrical surface of the outer edges of the fins 14 and the prepared inner surface of the insulating body 2 is such that a maximum gap of 0.1 mm. exists in the cold state. With this much play the body 1 and assembled fins 14 are easily inserted into place within the insulating body 2, but nevertheless, at elevated soldering temperatures, the expansion of the metallic body 1 and the fins 14 insures gap-free soldering between the fins 14 and the inner surface of the insulating casing 2. The process of machining the outer edges of the fins 14 gives a slight twist or bend to the fins 14, which allows them to flex during the heating of the second soldering process, so that excessive outward pressures on the insulating member 2 during soldering are avoided. Tensile-stresses, arising during cooling off after soldering, are also controlled by reversing the twisting which occurs during heating, and slight expansion of the fins 14 (by approximately 0.1 mm.) as the result of their ductile characteristics and their relatively fine structure.

The outer body 3 may also be soldered to the exterior of the casing 2 during the second soldering step, if desired, and this is particularly advantageous when the insulating casing 2 is not provided with a copper plating. It is preferable, when the outer body 3 is soldered to the insulating casing 2, that the outer body is enclosed during the soldering operation by a metal or graphite tube which has a lesser temperature expansion than copper, to maintain the outer body in contact with the ceramic tube and prevent the formation of cracks or fissures therebetween.

As illustrated in FIG. 1, a plurality of groups or wreaths of fins 14 are provided at longitudinally spaced positions along the hollow body 1, one for each one of the separate sections 13 of the insulating casing. Thus, the fins 14 are not longitudinal fins extending for the entire length of the collector, but are comprised by groups of shorter fins. This partitioning of the fins is particularly advantageous on relatively elongated collectors, in order to keep shearing tensions in the direction of the longitudinal axis to a minimum. In addition, each of the fins has a plurality of spaced slots or notches on the casing side, which also allow for the relief of stresses.

The present invention has excellent heat transmission characteristics and maintains such characteristics even at temperatures of nearly 1,000° C. The fin connection between the inner body 1 and the insulating casing 2 has a high elasticity, and the fin construction provides for a multiplicity of heat conducting paths which are of constant cross-sectional area as they project radially outwardly. Thus a heat accumulation which might result from a narrowing of the heat conducting path does not occur in the present invention. This provides for extremely favorable heat dissipation characteristics, especially for use with high power tubes, in which the quality of the collector is determined primarily by its heat dissipation characteristics. The apparatus of the present invention can be operated over wide temperatures, between room temperature and soldering temperature.

During assembly, in response to the heat of soldering, the core 1 twists and bends the fins against the insulating casing as it expands, and this prevents the build up of extreme pressures on the casing. A perfect soldering connection is provided between the copper body 1 and the ceramic casing 2, because of the expansion of the fins into contact with the casing. The resulting joints tolerate multiple heatings to soldering temperatures, and because of the relatively narrow soldering surfaces and the ductility of the copper fins, no cracks or separations form as the assembly cools.

The fins 14 are preferably as thin as possible, and are preferably on the order of 0.2 mm.

In order to provide an arrangement in which the fins 14 are uniformly yielding and flexible, it is high desirable that no soldering connection should exist between adjacent fins. For this reason it is preferable to provide the fins 14 with a chromium layer a few μm thick. The fins themselves are preferably produced by a stamping process, from a sheet which is provided with a chromium layer on upper and lower surfaces. The edges of the stamped fins are, therefore, chrome-free and are easily solderable.

In addition to the bending or twisting action described above which occurs as the outer edges of the fins 14 are machined, some of the edges are also spread or smeared by the machining process. This action is beneficial in that it increases the surface soldered between the fins 14 and the insulating casing, and promotes solder flow during soldering.

It will be appreciated that various modifications and additions may be made by those skilled in the art, without departing from the essential features of the present invention, which are intended to be defined and secured by the appended claims.

What is claimed is:

1. An electron beam collector for a high power electron beam tube comprising a metallic hollow body, a metallic outer body surrounding said hollow body, and a casing of electrically insulating material interposed between said two metallic bodies, said hollow body comprising a hollow body core and a plurality of longitudinal fins connected with the outer surface of said hollow body, said insulating casing being firmly connected to the outer edges of said fins, each of said fins being formed of sheet metal with a thickness of less than 0.5 mm.

2. Apparatus according to claim 1, wherein said hollow body core, said fins, and said outer body all consist of copper, and said insulating casing consists of beryllium oxide.

3. Apparatus according to claim 1, wherein said fins have a thickness of approximately 0.2 mm.

4. Apparatus according to claim 1, wherein each of said fins have a layer of chrome on their side surfaces.

5. Apparatus according to claim 1, including a solder connection interconnecting each of said fins to said hollow body core and a second solder connection connecting each of said fins to insulating casing.

6. Apparatus according to claim 1, including a plurality of longitudinal grooves provided on the outer surface of said hollow body core, at least one of said fins being inserted into each of said grooves.

7. Apparatus according to claim 1, wherein each of said fins each have a slot on the edge facing said insulating casing.

8. Apparatus according to claim 1, wherein said hollow body core is surrounded by two groups of sheet metal fins, said groups being spaced apart longitudinally of said body core, said insulating casing comprising two sections, said two sections being aligned longitudinally, each casing section being connected to a different one of said groups.

9. Apparatus according to claim 1, including a solder connection between said insulating casing and outer body.

10. Apparatus according to claim 1, including a metal layer applied to the inner surface of said insulating casing.

11. Apparatus according to claim 1, including a copper layer applied to the inner surface of said insulating casing.

12. Apparatus according to claim 1, including a plurality of cooling channels provided in the interior of said outer body.

13. A method of producing an electron beam collector for a high power electron beam tube, said collector having an inner metallic body, an outer metallic body, and an insulating casing interposed between said metallic bodies, comprising the steps of applying a layer of solder to the outer surface of said inner body, surrounding said inner body with a plurality of metallic fins having their edges in contact with the outer surface of said inner body, inserting said inner body and said fins into a hollow tube which has a lesser thermal co-efficient of expansion than the material comprising the inner body and said fins, raising the temperatue of said assembly to soldering temperature for soldering the inner ends of said fins to said inner body, removing said assembly from said tube, machining the outer edges of said fins, providing a layer of solder on the inner surface of said insulating casing, and soldering the outer edges of said fins to the solder layer on the inner surface of said insulating casing.

14. The method according to claim 13, including the step of metalizing the inner surface of said insulating casing, applying a copper layer to said metalized surface, and then applying a layer of solder to said copper layer.

15. The method according to claim 14, including the step of machining said copper layer before applying said solder layer.

* * * * *